US007158040B2

(12) United States Patent
Morris

(10) Patent No.: US 7,158,040 B2
(45) **Date of Patent: *Jan. 2, 2007**

(54) ENVIRONMENTAL CONDITION DETECTOR WITH AUDIBLE ALARM AND VOICE IDENTIFIER

(75) Inventor: Gary J. Morris, Morgantown, WV (US)

(73) Assignee: Sunbeam Products, Inc., Boca Raton, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/915,672

(22) Filed: Aug. 10, 2004

(65) Prior Publication Data

US 2005/0007255 A1 Jan. 13, 2005

Related U.S. Application Data

(63) Continuation of application No. 10/396,068, filed on Mar. 25, 2003, now Pat. No. 6,784,798, which is a continuation of application No. 09/651,454, filed on Aug. 30, 2000, now Pat. No. 6,600,424, which is a continuation of application No. 09/299,483, filed on Apr. 26, 1999, now Pat. No. 6,144,310.

(60) Provisional application No. 60/117,307, filed on Jan. 26, 1999.

(51) Int. Cl.
*G08B 17/10* (2006.01)

(52) U.S. Cl. ..... 340/628; 340/692; 340/384.71; 340/632

(58) Field of Classification Search ..... 340/628, 340/629, 630, 632, 521, 522, 577, 578, 381, 340/691.2, 691.8, 384, 384.6, 384.71
See application file for complete search history.

(56) References Cited

U.S. PATENT DOCUMENTS 3,906,491 A 9/1975 Gosswiller et al.

(Continued)

FOREIGN PATENT DOCUMENTS

WO WO 90/01759 2/1990

OTHER PUBLICATIONS

National Fire Protection Association—NFPA72—National Fire Alarm Code 1996 Edition pp. 72-1 and 72-28 through 72-32; 72-79. 72-104 through 72-106 Quincy, MA USA.

(Continued)

*Primary Examiner*—Jeffery Hofsass
*Assistant Examiner*—Hoi C. Lau
(74) *Attorney, Agent, or Firm*—Lawrence J. Shrupoff

(57) ABSTRACT

Due to the presence of various environmental condition detectors in the home and businesses such as smoke detectors, carbon monoxide detectors, natural gas detectors, etc., each having individual but similar sounding alarm patterns, it can be difficult for occupants of such dwellings to immediately determine the specific type of environmental condition that exists during an alarm condition. The present invention comprises an environmental condition detector using both tonal pattern alarms and pre-recorded voice messages to indicate information about the environmental condition being sensed. Single-station battery-powered and 120VAC detectors are described as are multiple-station interconnected 120 VAC powered detectors. The pre-recorded voice messages describe the type of environmental condition detected or the location of the environmental condition detector sensing the condition, or both, in addition to the tonal pattern alarm. Provisions are made for multilingual pre-recorded voice messages.

9 Claims, 5 Drawing Sheets

U.S. PATENT DOCUMENTS 4,065,767 A * 12/1977 Neuhof et al. ..... 340/384.4
4,101,872 A 7/1978 Pappas
4,141,007 A 2/1979 Kavasilios et al.
4,160,246 A 7/1979 Martin et al.
4,275,274 A 6/1981 English
4,282,519 A 8/1981 Haglund et al.
4,288,789 A 9/1981 Molinick et al.
4,335,379 A 6/1982 Martin
4,343,990 A 8/1982 Ueda
4,350,860 A 9/1982 Ueda
4,351,999 A 9/1982 Nagamoto et al.
4,363,031 A 12/1982 Reinowitz
4,365,315 A 12/1982 Jamnik
4,366,873 A 1/1983 Levy et al.
4,375,329 A 3/1983 Park
4,389,639 A 6/1983 Torii et al.
4,400,786 A 8/1983 Mandel et al.
4,453,222 A 6/1984 Goszyk
4,455,551 A 6/1984 Lemelson
4,481,507 A 11/1984 Takiguchi et al.
4,498,078 A 2/1985 Yoshimura et al.
4,500,971 A 2/1985 Futaki et al.
4,519,027 A 5/1985 Vogelsberg
4,531,114 A 7/1985 Topol et al.
4,560,978 A 12/1985 Lemelson
4,572,652 A 2/1986 Tada et al.
4,682,348 A 7/1987 Dawson et al.
4,688,021 A 8/1987 Buck et al.
4,698,619 A * 10/1987 Loeb ..... 340/384.71
4,746,912 A * 5/1988 Clifford et al. ..... 340/691.5
4,754,266 A 6/1988 Shand et al.
4,810,996 A 3/1989 Glen et al.
4,816,809 A * 3/1989 Kim ..... 340/692
4,821,027 A 4/1989 Mallory et al.
4,851,823 A 7/1989 Mori
4,862,147 A 8/1989 Thomas
4,894,642 A 1/1990 Ashbaugh et al.
4,904,988 A * 2/1990 Nesbit et al. ..... 340/628
4,940,965 A 7/1990 Umehara
4,951,045 A 8/1990 Knapp et al.
4,988,980 A 1/1991 Graham
5,019,805 A 5/1991 Curl et al.
5,103,206 A 4/1992 Yu
5,117,217 A 5/1992 Nykerk
5,153,567 A 10/1992 Chimento
5,229,753 A 7/1993 Berg et al.
5,291,183 A 3/1994 Chiang
5,349,338 A 9/1994 Routman et al.
5,379,028 A 1/1995 Chung
5,460,228 A 10/1995 Butler
5,506,565 A 4/1996 de Leon et al.
5,548,276 A 8/1996 Thomas
5,587,705 A 12/1996 Morris
5,657,380 A 8/1997 Mozer
5,663,714 A * 9/1997 Fray ..... 340/692
5,673,023 A 9/1997 Smith
5,724,020 A 3/1998 Hsu
5,726,629 A 3/1998 Yu
5,764,134 A 6/1998 Carr et al.
5,786,749 A 7/1998 Johnson et al.
5,786,768 A 7/1998 Chan et al.
5,793,280 A 8/1998 Hincher
5,798,686 A 8/1998 Schreiner
5,841,347 A 11/1998 Kim
5,846,089 A 12/1998 Weiss et al.
5,856,781 A 1/1999 Michel et al.
5,864,288 A 1/1999 Hogan
5,874,893 A 2/1999 Ford
5,877,698 A 3/1999 Kusnier et al.
5,886,631 A 3/1999 Ralph
5,894,275 A 4/1999 Swingle
5,898,369 A 4/1999 Godwin
5,905,438 A 5/1999 Weiss et al.
5,914,650 A 6/1999 Segan
5,936,515 A 8/1999 Right et al.
5,986,540 A 11/1999 Nakagaki et al.
6,043,750 A 3/2000 Mallory
6,097,289 A 8/2000 Li et al.
6,114,967 A * 9/2000 Yousif ..... 340/690
6,121,885 A 9/2000 Masone et al.
6,144,310 A * 11/2000 Morris ..... 340/692
6,307,482 B1 10/2001 Le Bel
6,323,780 B1 11/2001 Morris
6,344,799 B1 2/2002 Walker
6,600,424 B1 * 7/2003 Morris ..... 340/628
6,624,750 B1 * 9/2003 Marman et al. ..... 340/506
6,784,798 B1 * 8/2004 Morris ..... 340/628

OTHER PUBLICATIONS

NFPA 720, Recommended Practice for the Installation of Household Carbon Monoxide (CO) Warning Equipment 1998 Edition.
UL 217 ISBN 0-7629-0062-8, Single and Multiple Station Smoke Alarms, Mar. 16, 1998-Feb. 21, 1997.
UL 2034 ISBN 0-7629-274-9, Single and Multiple Station Carbon Monoxide Alarms, Dec. 21, 1998-Oct. 29, 1996.

* cited by examiner

ENVIRONMENTAL CONDITION DETECTOR WITH AUDIBLE ALARM AND VOICE IDENTIFIER

This application is a continuation of Ser. No. 10/396,068 filed Mar. 25, 2003, now U.S. Pat. No. 6,784,798; which is a continuation of Ser. No. 09/651,454 filed Aug. 30, 2000, now U.S. Pat. No. 6,600,424; which is a continuation of Ser. No. 09/299,483 filed Apr. 26, 1999, now U.S. Pat. No. 6,144,310; which is a utility application claiming the benefit of the earlier filing date of Provisional Ser. No. 60/117,307 filed Jan. 26, 1999.

BACKGROUND FOR THE INVENTION

1. Field of Invention

The present invention relates to environmental condition detection for dwellings including smoke detection, carbon monoxide gas detection, natural gas detection, propane gas detection, combination smoke and carbon monoxide gas detection, etc. such that the audible tonal pattern alarm emitted by a detector sensing an abnormal environmental condition is accompanied by a pre-recorded voice message that clearly indicates the specific type of condition sensed or the specific location of the detector sensing the condition, or both.

2. Background

With the widespread use of environmental condition detectors such as smoke detectors, carbon monoxide detectors, natural gas detectors, propane detectors, etc. in residences and businesses today, there is a critical need to provide definite distinction between the tonal pattern alarms emitted by each type of detector so that the occupants of the involved dwelling are immediately made aware of the specific type of condition detected along with its location so they can take the proper immediate action. Regulating and governing bodies for products of the home safety industry (National Fire Protection Association, Underwriters Laboratories, etc.) have recently regulated the tonal patterns emitted from such environmental detectors, however, much confusion still exists among the very similar tonal pattern alarms emitted by various detector types. This is particularly true for those individuals partially overcome by the environmental condition, those asleep when the alarm occurs, young children, or the elderly. Therefore, a need exists whereby the environmental detector sensing an abnormal condition plays a recorded voice message stating the specific condition and/or location of the condition in addition to the required tonal pattern alarm. In conventional smoke detectors and carbon monoxide detectors, there are silent periods within the prescribed audible tonal pattern alarms where recorded verbal messages such as "smoke" or "CO" or "carbon monoxide" or "smoke in basement" or "utility room" (as examples) may be played during this alarm silence period to clearly discriminate between the types of audible alarms and environmental conditions and where the environmental condition was detected. Such messages immediately provide the occupants in an involved dwelling important safety information during potentially hazardous environmental conditions. The occupants can make informed decisions about how to respond to the alarm condition. Occupants residing in the uninvolved area of the dwelling may choose to assist those residing in the involved area depending on the location and type of condition detected. The type of environmental condition sensed or the location of the condition, or both are immediately made clear through the use of recorded voice messages in addition to conventional tonal pattern alarms.

3. Discussion of Prior Art

While there are inventions in the prior art pertaining to emergency alarm systems utilizing verbal instructions, none are known to the inventor which use a combination of tonal pattern alarms and factory pre-recorded voice messages with function or intent to clearly and specifically identify and clarify which type of environmental condition is present in a dwelling. Nor are there known inventions that use such pre-recorded voice messages to specifically identify the location of the environmental condition sensed by environmental condition detectors in dwellings without the use of a central control unit.

Morris (U.S. Pat. No. 5,587,705) describes a wireless smoke detector system using a minimum of two smoke detectors to indicate the location of the smoke detector sensing the smoke through coded alarm patterns. The present invention does not use wireless communication between detectors; each detector may operate without any others or may operate as a hardwired system with interconnected units for those powered by 120 VAC. Fray (U.S. Pat. No. 5,663,714) describes a warning system for giving user-recorded verbal instructions during a fire. Fray teaches an object of his invention is to warn individuals of the presence of smoke and fire and to provide verbal instructions and guidance as how to escape the hazard. Routman et al (U.S. Pat. No. 5,349,338) describe a fire detector and alarm system that uses personally familiar user-recorded verbal messages specifically for a small child or adult in need of verbal instructions during the presence of a fire. Chiang (U.S. Pat. No. 5,291,183) describes a multi-functional alarming system using a microphone to sense ambient conditions and user-recorded verbal instructions for indicating the way to escape a fire. Kim (U.S. Pat. No. 4,816,809) describes a speaking fire alarm system that uses a central control system with remote temperature sensors. Haglund et al (U.S. Pat. No. 4,282,519) describe a hardwired smoke detector system whereby two audible alarm codes are indicated to determine whether the smoke was detected locally or not. Only two possible alarm patterns are used and no voice message is used with Haglund's hardwired system. Molinick and Sheilds (U.S. Pat. No. 4,288,789) describe an oral warning system for monitoring mining operations that uses a plurality of non-emergency condition sensors and second sensors for detecting emergencies. The patent further describes the use of a single and system-central multiple-track magnetic tape player for storing the verbal messages and links the alarm system to control the operation of mechanical devices (mining conveyor belts, etc.) during emergency conditions when verbal messages are played.

Additionally, Morris (U.S. Pat. No. 5,587,705), Fray (U.S. Pat. No. 5,663,714), Routman et al (U.S. Pat. No. 5,349,338), Chaing (U.S. Pat. No. 5,291,183), Kim (U.S. Pat. No. 4,816,809), and Haglund et al (U.S. Pat. No. 4,282,519) do not recite the specific use of factory pre-recorded voice messages to indicate the specific location of the environmental condition, or the use of voice messages to identify the specific type of environmental condition detected, or the use of a plurality of interconnected detectors emitting identical verbal messages. or a selectable means to define the installation location of the detector, all of which are taught in the present invention and afford significant safety advantages. While Molinick and Shields (U.S. Pat. No. 4,288,789) refer to verbally describing an emergency condition in mining operations, their patent teaches of a much more complex system than the present invention and describes a central control system with multiple stages of various configuration sensors and the use of user-recorded voice messages. Furthermore, the patent does not describe a selectable coding means to define the installation location of the sensors.

All known prior art providing user-recorded verbal instructions on how to escape a hazardous condition has become impractical for use in dwellings in view of the recent National Fire Protection Association (NFPA) and Underwriters Laboratories (UL) regulations that require a maximum silence period between tonal alarm patterns of 1.5 seconds (Ref UL2034, UL217, NFPA72 and NFPA720). This period of time is sufficient for the present invention to verbally indicate the type and location of the sensed environmental condition but is unlikely to be useful to provide detailed instructions, as taught in the prior art, to occupants on how to respond to a hazardous condition.

The present invention employs either single station environmental condition detectors or a system comprising direct hardwired communication links between a plurality of environmental condition detectors to provide a tonal pattern alarm with pre-recorded voice message information regarding the specific type of environmental condition detected or the specific location of the detector sensing the environmental condition, or both, all without the need of a centralized control unit. For detector embodiments using pre-recorded voice messages to indicate the location of the detected condition, each detector is set-up by the user during installation to define the physical location of the detector within the dwelling according to pre-defined location definitions pre-programmed into the electronic storage media. The recorded voice messages are pre-recorded into the electronic storage media during manufacture and are not normally changeable by the user. In view of the recent National Fire Protection Association and Underwriters Laboratories regulations for tonal pattern alarms, it is not practical to have the user record their own sounds during the silent periods of the tonal pattern. The user may choose to record other alarm sounds that would violate the regulations governing such tonal patterns and compromise the safety features of the device. The use of factory pre-recorded voice messages alleviates this problem.

It is emphasized that no other related prior art known to the inventor makes use of factory pre-recorded voice messages to indicate the location of the environmental condition or the type of condition or both. Sufficient addressable electronic memory is available in the preferred embodiment of the invention to afford numerous pre-recorded voice messages.

SUMMARY OF THE INVENTION

Described herein is the Environmental Condition Detector with Audible Alarm and Voice Identifier invention, which comprises an environmental condition detector, such as a smoke detector, carbon monoxide gas detector, natural gas detector, propane detector, or any combination detector thereof, which detects the desired environmental condition(s) by those methods well known and described in the art and emits the prescribed audible tonal pattern alarm in accordance with the industry's empowered governing bodies' (National Fire Protection Association, Underwriters Laboratories etc.) criteria for such environmental conditions. Simultaneously, the environmental condition detector sensing the condition emits a verbal message to indicate, through a recorded voice message or synthesized human voice, the condition being sensed. This recorded voice message is emitted simultaneously with the audible tonal pattern alarm so as normally to occur during silent segments of the prescribed tonal pattern alarm. For example, for the condition of smoke detection, the smoke detector emits the following combination audible tonal pattern alarm (Beep) and recorded voice message. "Beep - - - Beep - - - Beep - - - 'SMOKE' - - - Beep - - - Beep - - - Beep - - - 'SMOKE' - - - " in a periodic manner for as long as the environmental condition is detected. As a second example, for carbon monoxide detection, a carbon monoxide detector emits "Beep - - - Beep - - - Beep - - - Beep - - - 'CO' - - - Beep - - - Beep - - - Beep - - - Beep - - - 'CO' - - - ". As a third example, for smoke detection with the location identifier, a smoke detector emits "Beep - - - Beep - - - Beep - - - "SMOKE IN BASEMENT' - - - Beep - - - Beep - - - Beep - - - 'SMOKE IN BASEMENT' - - - ". As a fourth example, for carbon monoxide detection with a voice location only identifier, a carbon monoxide detector emits ""Beep - - - Beep - - - Beep - - - Beep - - - 'Utility Room' - - - Beep - - - Beep - - - Beep - - - Beep - - - 'Utility Room' - - - ".

OBJECTS AND ADVANTAGES OF THE PRESENT INVENTION

It is one object of the present invention to provide environmental condition detectors that function as single station (non-interconnected) detector units equipped to emit a tonal pattern alarm and a recorded voice message. The recorded voice message clearly identifies the location of the environmental condition detector sensing the condition, or describes the type of environmental condition that has been detected, or both, as illustrated in the above, non-exhaustive examples. The single station detector embodiment is battery powered or 120 VAC powered. User-selectable coding switches or jumpers permit the user to define the physical location of the single station unit within the dwelling. No other related prior art is known to the inventor that uses factory pre-recorded voice messages in combination with conventional tonal pattern alarms to indicate the specific type or specific location, or both, of an abnormal environmental condition as related to single station units.

It is another object of the present invention to provide an environmental condition detection system where one detector sensing an environmental condition causes all other interconnected detectors to emit identical tonal pattern alarms and recorded voice messages. The hardwired directly interconnected detectors forming the environmental condition detection system are 120 VAC powered with optional battery back-up and use the recorded voice message to identify the location of the environmental condition detector sensing the condition, or to describe the type of environmental condition that has been detected, or both, as illustrated in the above, non-exhaustive examples. The environmental condition detection system embodiments of the present invention do not require the use of a centralized control unit (control panel) between detectors. No other related prior art is known to the inventor that uses factory pre-recorded voice messages in combination with conventional tonal pattern alarms to indicate the specific type or specific location, or both of an abnormal environmental condition as related to a directly interconnected environmental condition detector system having no central control unit or panel.

A major advantage of both the single station embodiment and the system embodiment of the present invention is the use of factory pre-recorded voice messages that fit within the National Fire Protection Association and Underwriters Laboratories specified 1.5 second silence period of the standard smoke detector and carbon monoxide detector tonal pattern alarms. Prior art using user-recorded voice messages are intended to indicate directions on how to escape the hazard or how to respond to a hazard. Such messages would not practically fit into the maximum 1.5 second silent time period in conventional tonal alarm patterns for smoke detectors and carbon monoxide detectors used in dwellings. The allowance for a user to record his or her own messages may actually add to the confusion and danger that results during an alarm condition if the user chooses to record additional alarm sounds or errs in the directions given in the message on how to properly respond to a hazardous condition.

DETAILED DESCRIPTION OF THE INVENTION

Figure 1:
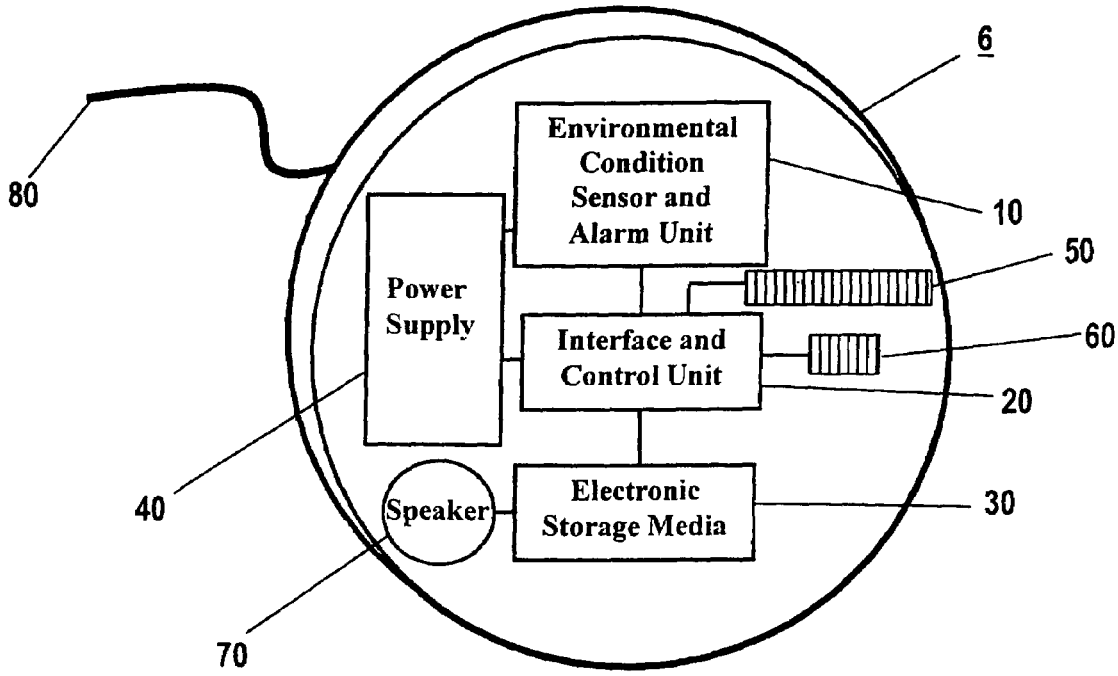
FIG. 1 is a sketch of a preferred embodiment of the Environmental Condition Detector with Alarm and Voice Identifier according to the invention.

A preferred embodiment of the Environmental Condition Detector with Alarm and Voice Identifier 6 is shown in FIG. 1. The unit is powered by a battery 40 and/or by standard 120 VAC (not shown). The environmental condition sensor and alarm unit 10 (conventional smoke detector, carbon monoxide detector, combination smoke detector and carbon monoxide detector, natural gas detector, propane detector, abnormal temperature etc.) is any sensor type(s) utilizing environmental detection methods and alarm devices typically known in the art of smoke detectors, carbon monoxide detectors and other hazard detectors. Upon sensing the environmental condition, the environmental condition sensor and alarm unit 10 sounds its tonal pattern alarm to indicate that an environmental condition has been sensed in the immediate area. The alarm pattern is a prescribed audible tonal pattern alarm corresponding to the environmental condition as set forth by the empowered governing body (National Fire Protection Association, Underwriters Laboratories etc.). The interface and control unit 20 electronically interfaces with the environmental condition sensor and alarm unit 10 and controls the timing of a recorded voice message that is emitted simultaneously with the audible tonal pattern alarm such that the recorded voice message is emitted only during the period when the audible tonal pattern alarm cycles through a silent period. In one embodiment, an electronic signal frequency counter (not shown) is used to determine when the silent period of the audible alarm is occurring. The recorded voice message or synthesized human voice message is factory-recorded on an electronic storage media 30 such as, but not limited to, a ROM device. The recorded voice message is emitted through a speaker or other audio transducer 70. For the embodiments of the invention requiring identification of the location of the environmental condition detector sensing the environmental condition, a selectable coding apparatus 50 (jumper selector or DIP switch) which connects to the interface and control unit 20 is provided to select one of several predefined physical locations of the environmental condition detectors within a residence. Recorded voice messages to identify physical locations consistent with the position of the selectable coding apparatus 50 are stored on the electronic storage media 30. The selectable coding apparatus 50 is set to correspond to the location within the dwelling where the particular environmental condition detector 6 is installed. A language code selector jumper set or DIP switch) 60 is used to choose the language type (English, Spanish. etc.) used by the recorded voice. For interconnected 120 VAC units, when one environmental condition detector sounds its tonal pattern alarm and recorded voice message, all interconnected units will sound identical tonal pattern alarms and recorded voice messages in temporal phase. For the environmental condition detection system embodiment, an interconnecting conductor set 80 sends and receives a coded electrical signal encoded and decoded by the interface and control unit 20 by the sending and receiving detector, respectively. The coding of the signal sent over the interconnecting conductor set determines what specific recorded voice message is played from the electronic storage media 30 at the interconnected but remotely located environmental condition detectors. Another embodiment of the invention shown in FIG. 3 uses several interconnection conductors which alleviates the need for electrical encoding and decoding of the signal sent and received over the interconnecting conductor set 80.

Figure 2:
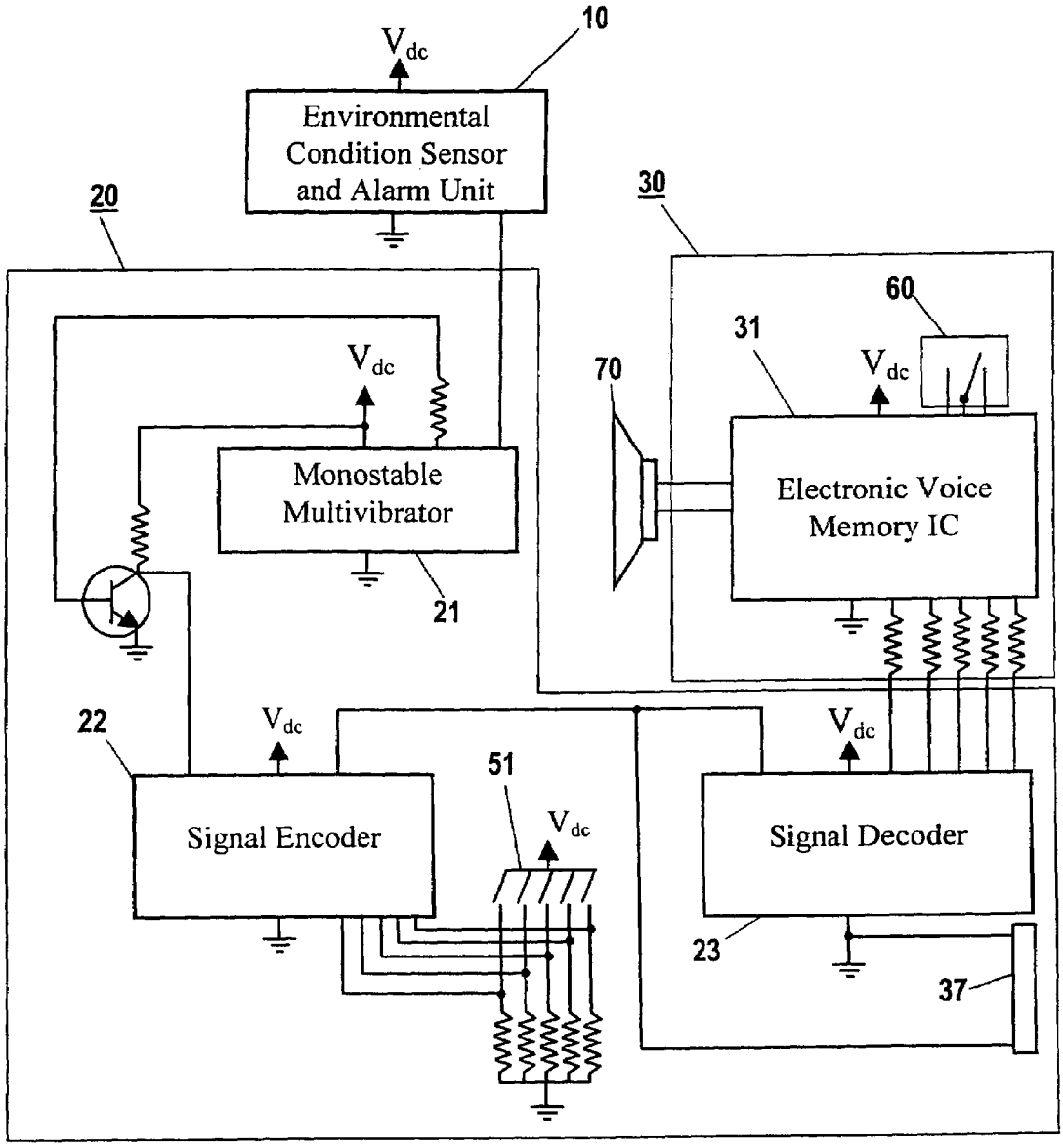
FIG. 2 is a sketch of a preferred embodiment of the electronic circuitry for the interconnected system embodiment of the Environmental Condition Detector with Alarm and Voice Identifier according to the invention.

Shown in FIG. 2 is a sketch of a preferred embodiment of the electronic circuitry for one detector unit of the interconnected system embodiment of the Environmental Condition Detector with Alarm and Voice Identifier. The environmental condition sensor and alarm unit 10 connects to the interface and control unit 20 to trigger the monostable multivibrator 21 for a predetermined period of time when an environmental condition is detected. The monostable multivibrator 21 enables the signal encoder 22 to send a coded electrical signal to the local signal decoder 23 and to all other signal decoders of interconnected detectors hardwired linked together through the conductor set 80 shown in FIG. 1. Upon receiving a local or remote encoded signal, the signal decoder 23 decodes the signal and validates or rejects the signal. Upon validation of a received signal, within each interconnected detector, the signal decoder 23 enables and addresses the electronic voice memory integrated circuit 31 to emit a recorded voice message verbally describing the location or type, or both of the environmental condition sensed. All recorded voice messages emitted by the interconnected detector units connected through the conductor set 80 via electrical conductor connector 37 are in temporal phase. A selectable coding apparatus of switches or jumpers 51 defines the physical installation location of each environmental condition detector through pre-defined location designations illustrated in FIG. 7. A language selector switch apparatus 60 is used to select which language is used during the playing of the recorded voice messages. The recorded voice message is played through a speaker 70.

Figure 3:
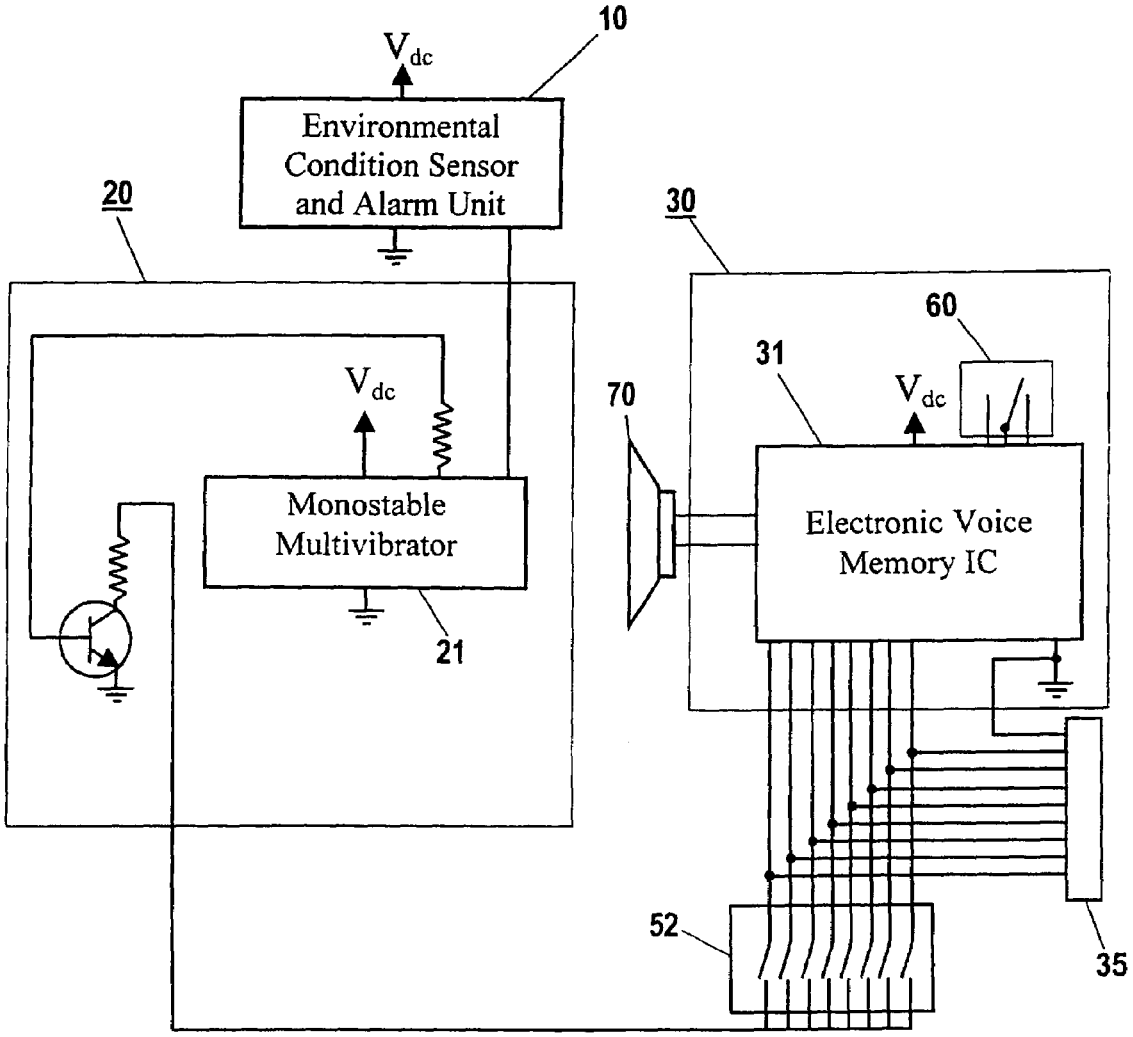
FIG. 3 is a sketch of a second preferred embodiment of the electronic circuitry for the interconnected system embodiment of the Environmental Condition Detector with Alarm and Voice Identifier according to the invention.

Shown in FIG. 3 is a sketch of a second preferred embodiment of the electronic circuitry for one detector unit for the interconnected system embodiment of the Environmental Condition Detector with Alarm and Voice Identifier. The environmental condition sensor and alarm unit 10 connects to the interface and control unit 20 to trigger the monostable multivibrator 21 for a predetermined period of time when an environmental condition is detected. The monostable multivibrator 21 enables the electronic voice memory integrated circuit 31 to emit a recorded voice message verbally describing the location or type, or both, of the environmental condition sensed. All detector units within the interconnected system share common electrical connection to the address bits on each detector unit's electronic voice memory integrated circuit 31 through a multiple conductor connector interface 35 which results in all detector units emitting identical recorded voice messages in temporal phase. A selectable coding apparatus of switches or jumpers 52 defines the physical installation location of each environmental condition detector through pre-defined location designations illustrated in FIG. 7. A language selector switch apparatus 60 is used to select which language is used during the playing of the recorded voice messages. The recorded voice message is played through a speaker 70.

Figure 4:
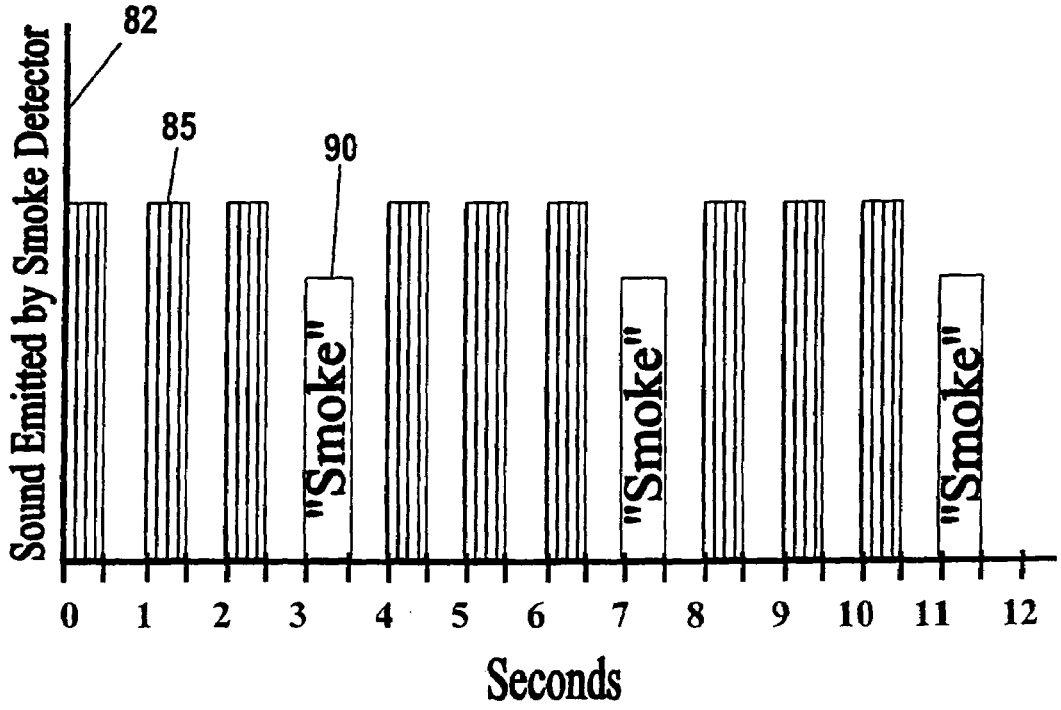
FIG. 4 shows an example audible tonal pattern alarm and recorded voice message combination used for the Environmental Condition Detector with Alarm and Voice Identifier configured as a smoke detector and using a recorded voice message as an environmental condition type identifier according to the invention.

Shown in FIG. 4 is an example alarm timing plot of the sound emitted 82 by an environmental condition detector using both an audible tonal pattern alarm 85 and a recorded voice message 90 to convey information about the specific environmental condition detected. In the example exhibited in FIG. 2, the environmental condition detector embodiment is a smoke detector using voice as an environmental condition type identifier only. The recorded voice message 90 is inserted into the defined silence periods of the prescribed audible tonal pattern alarm 85 consistent with conventional smoke detector alarms.

Figure 5:
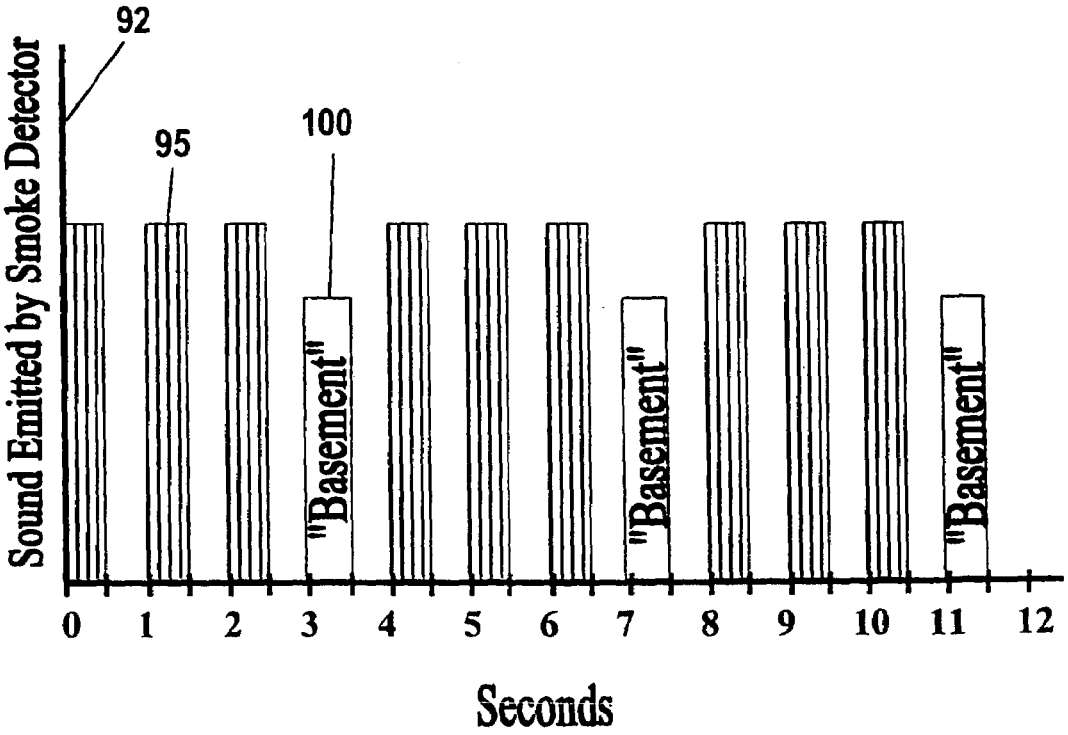
FIG. 5 shows an example audible tonal pattern alarm and recorded voice message combination used for the Environmental Condition Detector with Alarm and Voice Identifier configured as a smoke detector using a recorded voice message as an environmental condition location identifier according to the invention.

Shown in FIG. 5 is an example alarm timing plot of the sound emitted 92 by an environmental condition detector using an audible tonal pattern alarm 95 to convey the specific type of environmental condition and a recorded voice message 100 to convey the location of the detected environmental condition. In the example exhibited in FIG. 5, the environmental condition detector embodiment is a smoke detector using voice as an environmental condition location identifier only. The recorded voice message 100 is inserted into the defined silence periods of the prescribed audible tonal pattern alarm 95 consistent with conventional smoke detector alarms.

Figure 6:
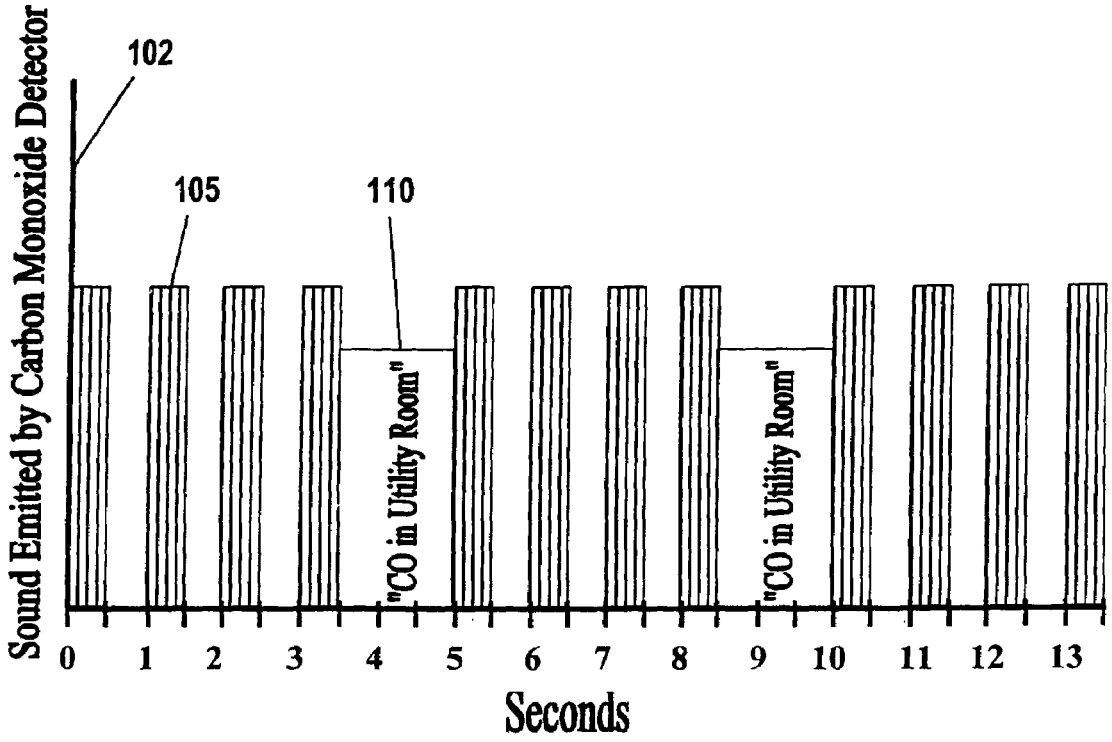
FIG. 6 shows an example audible tonal pattern alarm and recorded voice message combination used for the Environmental Condition Detector with Alarm and Voice identifier configured as a carbon monoxide detector and using a recorded voice message as an environmental condition type identifier and location identifier according to the invention.

Shown in FIG. 6 is an example alarm timing plot of sound emitted 102 by an environmental condition detector using an audible tonal pattern alarm 105 and a recorded voice message 110 to convey the specific type of environmental condition detected and the location of the environmental condition detector sensing the environmental condition. In the example exhibited in FIG. 6, the environmental condition detector embodiment is a carbon monoxide detector using voice as both an environmental condition type identifier and location identifier. The recorded voice message 110 is inserted into the defined silence periods of the prescribed audible tonal pattern alarm 105 consistent with conventional carbon monoxide alarms. The example tonal pattern alarms and recorded voice messages are illustrative and not intended to provide an exhaustive exhibit of all possible tonal alarm patterns and recorded voice messages.

Figure 7:
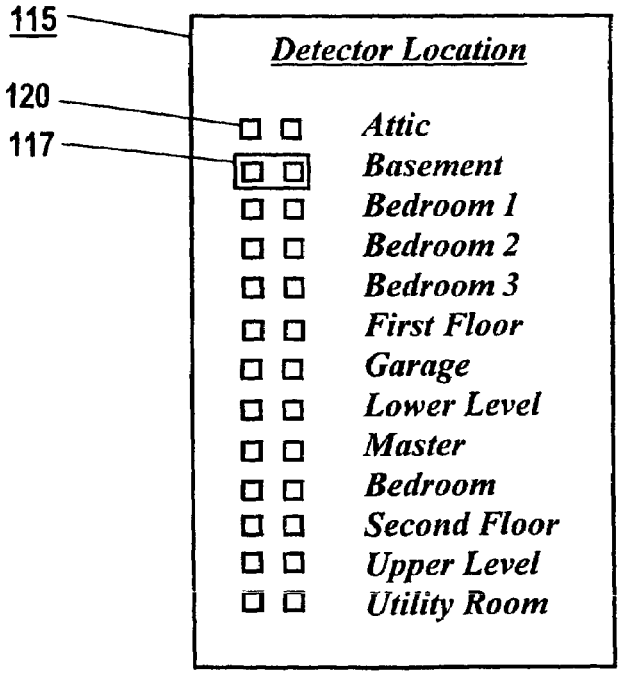
FIG. 7 shows one method for the user to select the installation location coding of the Environmental Condition Detector with Alarm and Voice Identifier according to the invention.

Shown in FIG. 7 is a selectable coding apparatus 115 for the user to select one of the pre-defined locations of the Environmental Condition Detector with Alarm and Voice Identifier embodiment when and where it is installed in a dwelling. Selectable coding means such as a jumper 117 on DIP header pins 120 or DIP switches (not shown) are simple methods to define the installation location of a detector embodiment. Typical dwelling locations are shown in FIG. 7 and are not intended to exhibit an exhaustive list.

The various preferred embodiments described above are merely descriptive of the present invention and are in no way intended to limit the scope of the invention. Modifications of the present invention will become obvious to those skilled in the art in light of the detailed description above, and such modifications are intended to fall within the scope of the appended claims.

I claim:

1. An ambient condition detector comprising: first and second, ambient condition sensors; control electronics coupled to the sensors wherein the electronics emits at least two, different, unalterable pre-established alarm indicating tonal, output patterns wherein each pattern includes predetermined silent intervals and each is associated with a respective one of the sensors; voice output circuitry, coupled to the electronics, wherein the voice circuitry can output at least two different user unalterable, verbal alarm output messages wherein each of the messages is associated with a respective one of the tonal output patterns and verbalizes the respective alarm type and wherein the control electronics, in response to a detected alarm condition, outputs an audio representation of a respective one of the tonal patterns and an interleaved respective verbal alarm type message in a respective silent interval; wherein each tonal output pattern defines groups of substantially identical output tones with constant intragroup spacing of a first amount and constant intergroup spacing of a second amount wherein the second amount is at least two times greater than the first amount; and a common housing for the sensors, the electronics and the output circuitry.

2. A detector as in claim 1 wherein one of the sensors is a smoke sensor and the respective, verbal message is a fire alarm to reinforce the respective tonal output pattern indicative of a fire alarm.

3. A detector as in claim 2 wherein the other sensor is a carbon monoxide sensor and the respective verbal message is a carbon monoxide alarm to reinforce the respective tonal output pattern, indicative of a carbon monoxide alarm.

4. A detector as in claim 3 wherein at least one tonal output pattern defines groups of three substantially identical output tones with constant intragroup spacing of a first amount and constant intergroup spacing of a second amount wherein another tonal output pattern defines groups of four substantially identical output tones with constant intragroup spacing of a third amount and constant intergroup spacing of a fourth amount.

5. A detector as in claim 4 wherein each tone of one tonal pattern has a duration on the order of 0.5 seconds.

6. A detector as in claim 1 wherein one tonal pattern has an intragroup spacing on the order of 0.5 seconds and an intergroup spacing on the order of 1.5 seconds.

7. A detector as in claim 1 which includes a plurality of predetermined location specifying messages.

8. A detector as in claim 7 which includes a manually operable element for selecting a location specifying message.

9. An ambient condition detector comprising: a fire sensor and a gas sensor; control electronics coupled to the sensors wherein the electronics emits at least first and second, different, unalterable alarm indicating tonal, output patterns wherein each pattern includes groups of spaced apart tones separated by longer intergroup silent intervals and wherein each output pattern is associated with a respective one of the sensors; voice output circuitry, coupled to the electronics, wherein the voice circuitry includes at least two pre-established, user unalterable, verbal alarm output messages wherein each of the messages is associated with a respective one of the tonal output patterns and verbalizes the respective alarm type and wherein the control electronics, in response to a detected alarm condition, outputs an audio representation of a respective one of the tonal patterns and an interleaved respective verbal alarm type message in a respective intergroup silent interval; wherein the first tonal output pattern, associated with the fire sensor, comprises a selected number of tones in each group with intragroup tonal spacing less than 50% of the respective intergroup silent interval and wherein the second tonal output pattern, associated with the gas sensor, comprises a greater number of tones in each group than the selected number of tones; and a common housing for the sensors, the electronics and the output circuitry.

* * * * *

UNITED STATES PATENT AND TRADEMARK OFFICE

CERTIFICATE OF CORRECTION

PATENT NO. : 7,158,040 B2
APPLICATION NO. : 10/915672
DATED : January 2, 2007
INVENTOR(S) : Gary J. Morris It is certified that error appears in the above-identified patent and that said Letters Patent is hereby corrected as shown below:

On the Title page Item (73), "Assignee: Sunbeam Products, Inc., Boca Raton, FL (US)" should be deleted.

Signed and Sealed this

Twenty-ninth Day of July, 2008

JON W. DUDAS
*Director of the United States Patent and Trademark Office*